US005718475A

United States Patent [19]

Watts

[11] Patent Number: 5,718,475

[45] Date of Patent: Feb. 17, 1998

[54] PIVOTAL SUPPORT ASSEMBLY FOR A CONVERTIBLE BENCH/TABLE CONTAINER APPARATUS

[75] Inventor: Stephen P. Watts, Provo, Utah

[73] Assignee: Premiere Products, Inc., Provo, Utah

[21] Appl. No.: 694,167

[22] Filed: Aug. 8, 1996

[51] Int. Cl.[6] ..... A47B 85/04

[52] U.S. Cl. ..... 297/127; 297/188.1

[58] Field of Search ..... 297/119, 118, 297/125–127, 411.38, 188.01, 188.08, 188.09, 188.1, 160–162, 115

[56] References Cited

U.S. PATENT DOCUMENTS

| | | | |
|---|---|---|---|
| 302,005 | 7/1884 | Lamdin | 297/188.1 |
| 986,686 | 3/1911 | Carney | 297/188.1 |
| 1,049,394 | 1/1913 | Predock | 297/188.1 |
| 1,532,417 | 4/1925 | Letts | 297/121 |
| 1,757,960 | 5/1930 | Greenstreet | 297/124 |
| 1,890,129 | 12/1932 | Ross | 155/43 |
| 2,481,935 | 9/1949 | Larson | 155/43 |
| 2,506,852 | 5/1950 | Barcus | 155/43 |
| 2,856,985 | 10/1958 | Lepper | 155/124 |
| 2,882,957 | 4/1959 | Anderson | 155/43 |
| 2,922,463 | 1/1960 | Johnston | 155/43 |
| 2,959,209 | 11/1960 | Lakin | 155/43 |
| 4,615,559 | 10/1986 | Blondeau | 297/124 |
| 4,883,317 | 11/1989 | Davenport | 297/188.1 |
| 5,292,172 | 3/1994 | Watts et al. | 297/127 |
| 5,398,990 | 3/1995 | Watts et al. | 297/127 |
| 5,458,395 | 10/1995 | Skarda, Jr. | 297/188.1 |

OTHER PUBLICATIONS

"Easy Projects to Build & Finish," *Weekend Woodcrafts*, pp. 8–11, Issue 10, Aug.1993.

*Primary Examiner*—Milton Nelson, Jr.

*Attorney, Agent, or Firm*—Berne S. Broadbent; Dale E. Hulse

[57] ABSTRACT

A convertible bench/table container apparatus is disclosed in one presently preferred embodiment of the present device as including a support container assembly having an internal storage chamber disposed therein for the purpose of storing children's toys, clothing, blankets, etc. or for use as an ice chest, food receptacle, etc. In preferred construction, the support container assembly may be formed having a base board member and one or more openable seat members to facilitate access to the internal storage chamber of the support container assembly. Preferably, the seat members are hingeably attached at a first end to the base board member and operably disposed in alignment with a raised rim of the upper portion of the support container assembly which provides structural support to the seat members in a closed position. Mountably engaging the base board member is a pivotal support assembly which provides structural support to the convertible bench/table container apparatus by the armrest assembly when the backrest/tabletop is pivoted from a first position, providing a park or lawn bench structure, into a second position, providing a tabletop (or desktop). Structurally, the pivotal support assembly accommodates the movement of the backrest/tabletop into either the first position or the second position, as outlined above, and comprises a point of rotation thereabout.

19 Claims, 7 Drawing Sheets

PIVOTAL SUPPORT ASSEMBLY FOR A CONVERTIBLE BENCH/TABLE CONTAINER APPARATUS

BACKGROUND

1. The Field of the Invention

This invention relates to recreational furniture, and more particularly, to a convertible bench/table container apparatus which conveniently transforms a backrest structure into a tabletop by means of incorporating a novel pivotal support assembly that provides sufficient structural support to the bench/table container apparatus when the backrest is pivoted to provide the tabletop (or desktop).

2. The Background Art

Persons owning homes are common consumers of recreational patio and pool furniture. In most instances, homeowners purchase patio and pool furniture for the convenience and comfort they provide when leisurely relaxing outside or near a pool. Consumers of recreational furniture usually have an interest in the aesthetic beauty of a piece of patio or pool furniture and intend such furnishings to enhance the settings of their homes and to add decoration to their pool areas.

Benches have traditionally provided persons with a place to sit and relax in the yard, on the porch or near a pool. Correspondingly, many homeowners purchase benches made of natural woods and finish them with a weather protecting varnish to ensure the longevity of the wood against the elements of nature. Although park or lawn benches have traditionally provided a means of sitting and relaxing in an outdoor setting, when it comes time to eating, finding a tabletop to support the dinnerware and food to be eaten may not be readily accessible.

Many homeowners have, accordingly, purchase picnic tables as a means for placing foods thereon and in order to provide appropriate seating therearound for those persons eating. If merely a flat surface is required to place food and a seat is needed for seating for those persons eating, then a picnic table generally suffices. However, when the meal is concluded, the seat associated with the picnic table no longer provides a comfortable advantage to those individuals seeking to relax and enjoy the outdoor setting. Typically, the only option of comfort while sitting at a picnic table is to lean forward and support one's elbows on the tabletop. Although a picnic table may provide sufficient functionality while eating, when it comes time to relax and enjoy the pleasant outdoor weather while communicating with family or friends, a park or lawn bench usually provides a more comfortable piece of furniture.

In view of the foregoing, a number of attempts have been made in the past to manufacture a convertible bench/table structure which provides a seat and backrest in one position, which can be further transformed into a seat with a tabletop structure, analogous to a picnic table, in a second position. Although the prior art combination park bench and picnic table afford significant advantages over the use of separate tables, benches and chairs, significant disadvantages inherently remain.

For example, consumers generally desire a combination bench/table structure which provides a simple and easy means of converting the seat and backrest of the bench into the picnic table formation. Unfortunately, however, the prior art typically employs complicated mechanical laches and multiple pivotal points to accommodate a conformational transformation of the park or lawn bench into a picnic table for dining. Likewise, the various components of the prior art typically rely on multiple working parts such as, for example, a plurality of nut and bolt assemblies, an array of pivotal joints, etc. in order to construct a final working unit. Based on the numerous mechanical working parts provided by prior art bench/table structures, production and manufacturing costs are proportionately increased and may be ultimately passed on to the consumer.

In addition, the multiplicity of working parts, the arrangement of various nut and bolt assemblies, and the array of pivotal joints in the final construction of prior art bench/table structures, usually present the consumer with a frustrating assembly process. In most situations, the consumer ends up trying to read and interpret lengthy and somewhat complicated instructions in an attempt to assemble a working design of prior art convertible bench/table structures to obtain any functional use of these devices.

Another significant disadvantage to prior art combination bench/table structures is the difficulty and sometimes awkward means of converting the bench and backrest into the picnic table conformation. In some instances, not only do pivotal pins have to be adjusted or frame members slidably modified in their adjacent slots, but many known prior art convertible bench/table devices, the repositioning of the backrest into the tabletop position requires more than one individual to accomplish this conformation change.

Considering all these factors, the prior art generally demands that consumers sacrifice a lengthy investment of time in assembling a final working unit. And with the significant number of mechanical working parts to assemble, the process of constructing prior art bench/table structures is generally intensified, thus forcing consumers to meticulously wade through in-depth and sometimes over technical instructions to realize any use from their so-called "recreational" furniture.

BRIEF SUMMARY AND OBJECTS OF THE INVENTION

In view of the foregoing, it is a primary object of the present invention to provide a new and improved functional and structural design for convertible bench/table apparatus and convertible bench/table container apparatus.

Another object of the present invention is to provide an aesthetically pleasing piece of recreational furniture which may be made of a natural redwood construction for finishing with an outdoor ultraviolet weather resistant stain to preserve the beauty of the wood.

An additional object of the present invention is to provide a reduction in the number of mechanical working parts that will effect a decrease in the overall manufacturing and production costs of a convertible bench/table apparatus or convertible bench/table container apparatus.

Further, it is an object of the present invention to provide a convertible bench/table apparatus and/or a convertible bench/table container apparatus which is easy to assemble.

It is a still further object of the present invention to provide a simpler, safer and less awkward means for converting the backrest of the bench into a tabletop formation.

In addition, it is a still further object of the present invention to provide a convertible bench/table container apparatus comprising means for providing storage capacity.

Consistent with the foregoing objects, and in accordance with the invention as embodied and broadly described herein, a convertible bench/table container apparatus is disclosed in one presently preferred embodiment of the present invention as including a support container assembly having an internal storage chamber disposed therein for the purpose of storing children's toys, clothing, blankets, etc. or for use as an ice chest, food receptacle, etc. In preferred construction, the support container assembly may be formed having a base board member and one or more openable seat members which provide means for facilitating access to the internal storage chamber of the support container assembly. Preferably, the seat members are hingeably attached at a first end to the base board member and operably disposed in alignment with a raised rim of the upper portion of the support container assembly which provides structural support to the seat members in a closed position.

Mountably engaging the base board member is a novel pivotal armrest assembly which provides structural support to the convertible bench/table container apparatus when the backrest/tabletop is pivoted from a first position, providing a park or lawn bench structure, into a second position, providing a tabletop (or desktop) structure. Structurally, the pivotal support assembly accommodates the movement of the backrest/tabletop into either the first position or the second position, as outlined above, and comprises means whereby providing a point of rotation thereabout.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 11, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
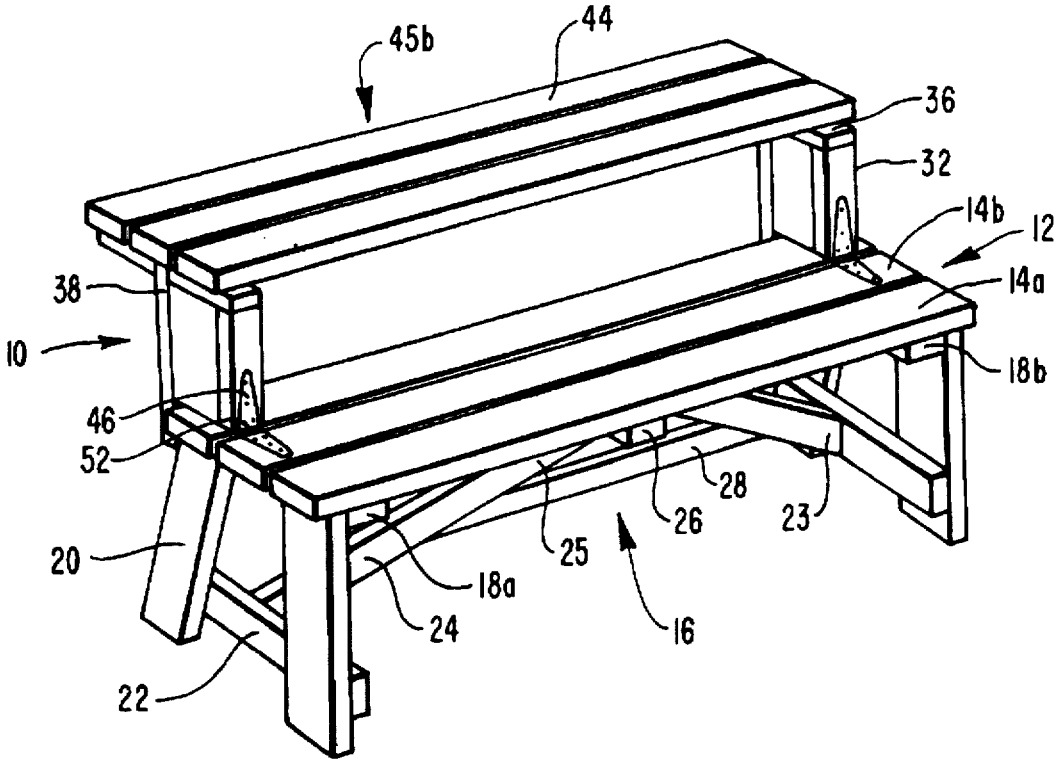
FIG. 1 is a perspective view illustrating one presently preferred embodiment of the convertible bench/table apparatus of the present invention, the apparatus being shown in a tabletop position.
Figure 2:
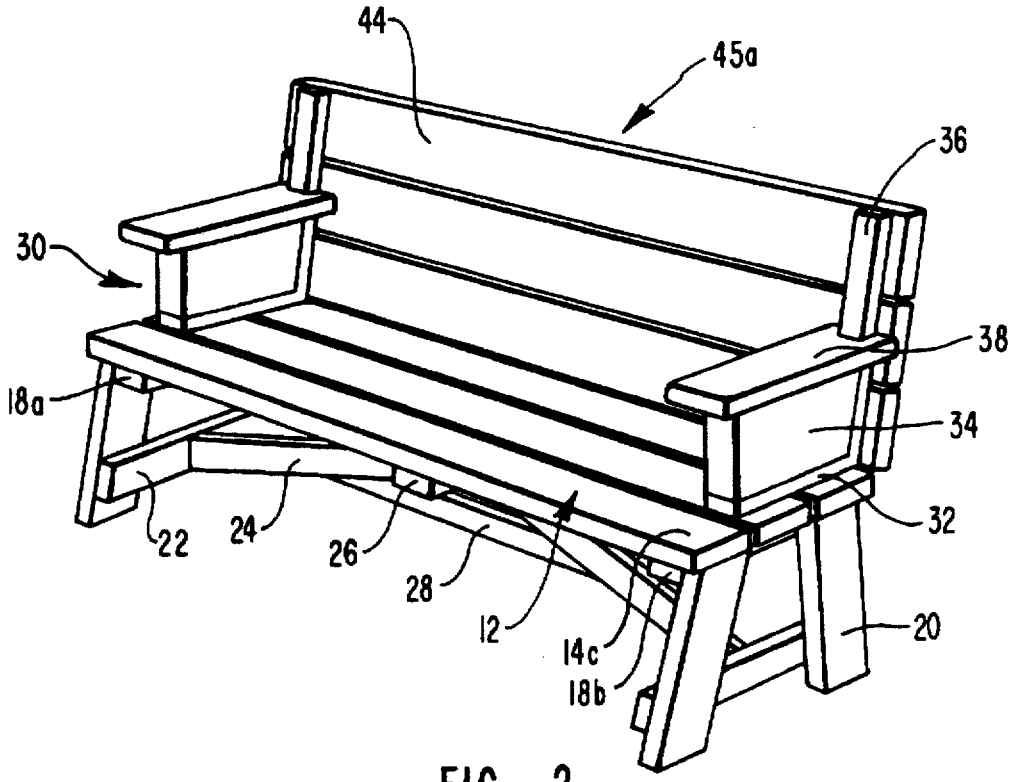
FIG. 2 is a perspective view illustrating one presently preferred embodiment of the convertible bench/table apparatus of the present invention, the apparatus being shown in a bench formation.

FIGS. 1 and 2 illustrate one presently preferred embodiment of the convertible bench/table apparatus, designated generally at 10, which includes a seat 12 comprising longitudinal seat boards 14*a*, 14*b*, 14*c* positioned over a support frame 16. The longitudinal seat boards 14*a*, 14*b*, 14*c* extend substantially horizontal above and across the support frame 16 and are preferably fixed to seat supports 18*a*, 18*b* at each end of the support frame 16 by fasteners, such as, for example, screws, bolts, rivets, nails, etc.

Adjacent the seat supports 18*a*, 18*b* are a plurality of seat support legs 20. The seat support legs 20 are preferably composed of a sturdy wood with relative thickness and durability for reinforcing the seat 12 and the weight applied thereagainst. The seat support legs 20 vertically engage the seat supports 18*a*, 18*b* at a slight inward angle from the base of each respective seat support leg 20. The height of the seat 12 is determinative from the vertical length and height of the seat support legs 20 when positioned thereunder and adjacent the support frame 16. The seat supports 18*a*, 18*b* may be mounted and secured to seat support legs 20 by fasteners, such as, for example, screws, bolts, rivets, nails, etc.

A cross-sectional support means 22 connects the two seat support legs 20 found on one side of the frame 16. The cross-sectional support means 22 horizontally engages the inner side of two seat support legs 20 at a position close to the base of each support leg. The cross-sectional support means 22 is rigidly attached to each support leg 20 by fasteners, such as, for example, screws, bolts, rivets, nails, etc.

Two seat cross-braces 24, preferably made of wood, extend from the cross-sectional support means 22 substantially upward between approximately 30° and 35° to meet a midsection seat brace 26 positioned approximately half-way between the seat supports 18*a*, 18*b*. A proximal end 23 of each seat cross-brace 24 is preferably rigidly connected to the adjoining cross-sectional support means 22 by fasteners, such as, for example, screws, bolts, rivets, nails, etc., which may be passed through the seat cross-braces 24 and further introduced into the adjoining cross-sectional support means 22. A distal end 25 of each upward extending seat cross-brace 24 preferably engages the underside and/or opposite side of the midsection seat brace 26. The association between the seat cross-braces 24 and the midsection seat brace 26 involves means for rigidly attaching the seat cross-braces to the underside and/or the opposite side of the midsection seat brace. Preferably fastened to the upper surface of the midsection seat brace 26 are the longitudinal seat boards 14*a*, 14*b*, 14*c* of the seat 12.

In current design, a horizontal reinforcement slat 28 lies underneath and parallel to the seat 12 and is operably connected to the adjacent seat cross-braces 24. The opposing ends of the reinforcement slat 28 are respectively secured at a mid-point on the adjacent seat cross-brace 24 by passing fasteners, such as, for example, screws, bolts rivets, nails, etc., through the ends of the horizontal reinforcement slat 28 and into the adjoining seat cross-brace 24. In structure, the horizontal reinforcement slat 28 provides overall structural integrity to the support frame 16 and seat 12 of one presently preferred embodiment of the convertible bench/table apparatus 10 to counteract the depression of forces exercised thereupon.

Resting upon the support frame 16 in a second position, as represented in FIG. 2, are preferably two armrest assemblies 30. In one presently preferred embodiment of the present invention, the armrest assembly 30 is composed of a four piece assembly, comprising: (1) a base board 32; (2) a second member 34, rectangular in shape and comprising a majority of the body of the armrest assembly 30, where the height of the second member 34 directly relates to the height consistency of the tabletop 45*b* when the convertible bench/table apparatus 10 is in a first position as represented in FIG. 1; (3) a lateral extension 38 resting on top of the second member 34 and extending transversely a greater length than the base board 32 and the second member 34; and (4) a backboard member 36 that extends substantially upward and is interposed along the backside of the horizontal base board 32, the second member 34, and the lateral extension 38 and being rigidly attached thereto by fasteners, such as, for example, screws, bolts, rivets, nails, etc. or secured by means of a conventional adhesive. The combination of the base board 32, the second member 34, the backboard member 36, and the lateral extension 38 preferably comprises a preferred embodiment of the armrest assembly 30 with each member thereof being secured to each other by fasteners, such as, for example, screws, bolts, rivets, nails, etc. or by means of a conventional adhesive.

Preferably, attached to the backside of the backboard member 36 of the armrest assembly 30 are longitudinal boards 44. The longitudinal boards 44 are preferably mounted to the backboard member 36 by fasteners, such as screws, bolts, rivets, nails, etc. or by means of a conventional adhesive, to form a backrest/tabletop 45. When the convertible bench/table 10 is in the second position as represented in FIG. 2, the backboard member 36 lies in a upright position providing a backrest 45*a* for the seat 12 and exposing a bench for sitting and relaxing, while a significant portion of the body of the armrest assembly 30 lies substantially horizontal against at least one seat board 14. When the convertible bench/table 10 is manipulated into the first position as represented by FIG. 1, the backboard member 36 lies substantially horizontal exhibiting a tabletop 45*b* and providing a table for having a picnic, while the body of the armrest assembly 30 rests on its side in a substantially upright position.

Figure 4:
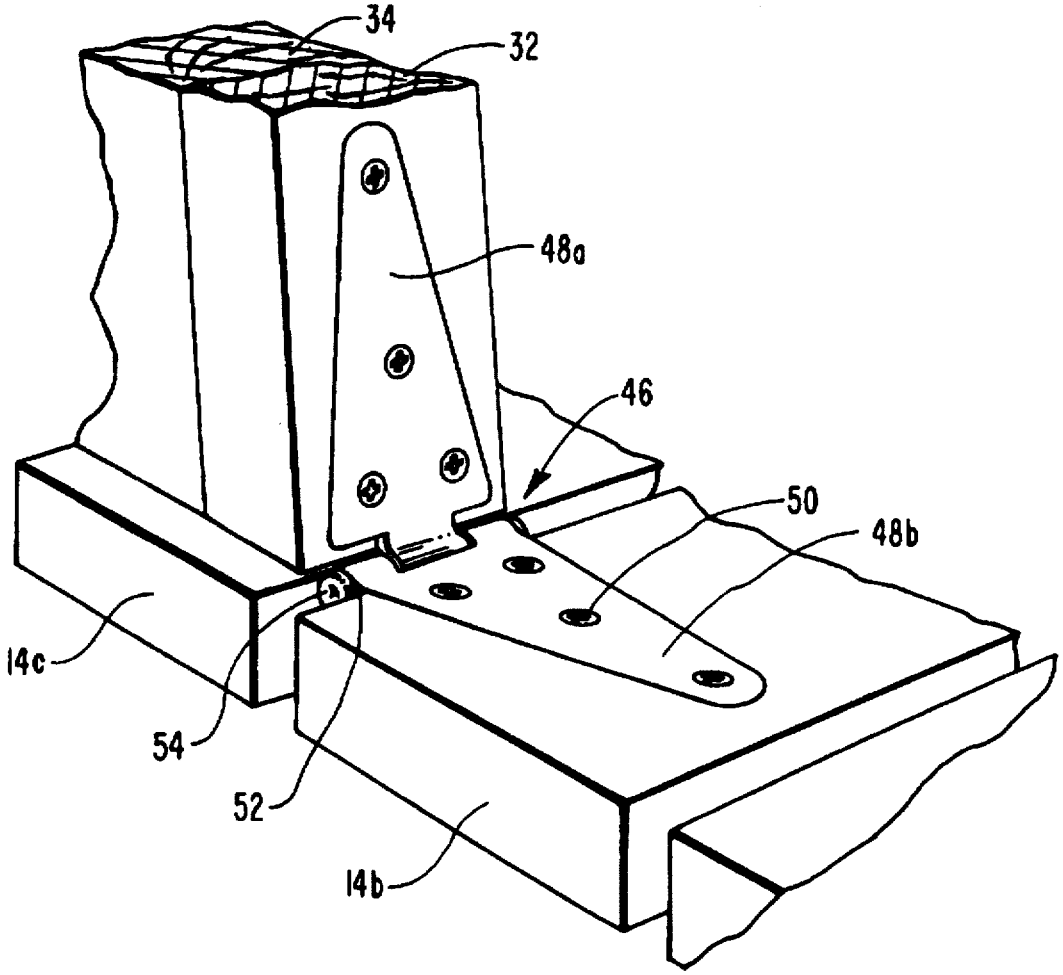
FIG. 4 is an enlarged perspective view taken along lines 4—4 of FIG. 3 showing the hinge mechanism of one presently preferred embodiment of the armrest assembly which provides means for pivoting the convertible bench/table apparatus from a first position to a second position.

As best illustrated in FIG. 4, affixed to the underside of the base board 32 of one presently preferred embodiment of the armrest assembly 30 is a hinge bracket arm 48*a* which allows the armrest assembly to be pivoted from a horizontal position into a vertical position, whereby the backrest/tabletop 45 may be transformed from a bench with a backrest into a picnic table. The second arm 48*b* of the hinge bracket 46 is preferably rigidly attached to the longitudinal seat board 14*b*. The intimacy of these connections is preferably achieved by means comprising a multiple of openings 50 formed in each hinge arm 48*a*, 48*b* of the hinge bracket 46 in which fasteners, such as, for example, screws, bolts, rivets, nails, etc., may be introduced therethrough and into the base board 32 with preferably a slight introduction into the body of the second member 34 of the armrest assembly 30.

The introduction of fasteners through the openings 50 formed in the hinge arms 48*a*, 48*b* of the hinge bracket 46 and which may be further fed into the body of the armrest assembly 30 and the longitudinal seat board 14*b*, conforms to a stable junction where a pivotal means can be established therefrom. Located medially between the two bracket arms 48*a*, 48*b* of the hinge bracket 46, is an aperture 52 whereby a suitable hinge pin 54 may be inserted to accommodate the pivotal motion of the convertible bench/table 10 from the first position as represented in FIG. 1, to the second position as represented in FIG. 2, or vice versa. Removably housing the hinge pin 54, the aperture 52 is preferably positioned substantially between the hinge bracket arms 48*a*, 48*b* in such a manner that when the backrest/tabletop 45 is pivoted around the medial axis of the hinge bracket 46, the backrest 45*a* may become a suitable tabletop 45*b* structurally supported by the armrest assembly 30.

In preferred construction, the base board 32 and the second member 34 of the armrest assembly 30 facilitate a surface abutment against the seat 12 by acting as a first structural stop 40 when the convertible bench/table 10 is in a tabletop 45*b* formation, as depicted in FIG. 1. The first structural stop 40 provides means of structural integrity to the tabletop 45*b* and the forces applied thereagainst.

The lateral extension 38 of the armrest assembly 30 preferably provides a surface abutment against the longitudinal seat board 14*c* to provide a second structural stop 42 for support of the tabletop 45*b* when the convertible bench/table 10 is in the first position, as represented in FIG. 1. The portion of the lateral extension 38 of the armrest assembly 30 which extends beyond the second member 34 of the armrest assembly 30 becomes substantially displaced vertically when the convertible bench/table 10 is pivoted at the hinge bracket 46. Upon the vertical displacement of the backrest/tabletop 45, the lateral extension 38 of the armrest assembly 30 preferably abuts the forward seat support leg 20, as well as the front side of the longitudinal seat board 14*c*, thereby exerting a functional restriction on any further forward pivoting movement on the part of the backrest/tabletop 45, thus conforming to a second structural support stop 42.

When the presently preferred embodiment of the present invention is in the second position as shown in FIG. 2, the convertible bench/table 10 conforms to a suitable bench with a seat 12, backrest 45*a*, and at least one armrest assembly 30 which provides means for additional comfort to those persons relaxing thereupon.

Figure 5:
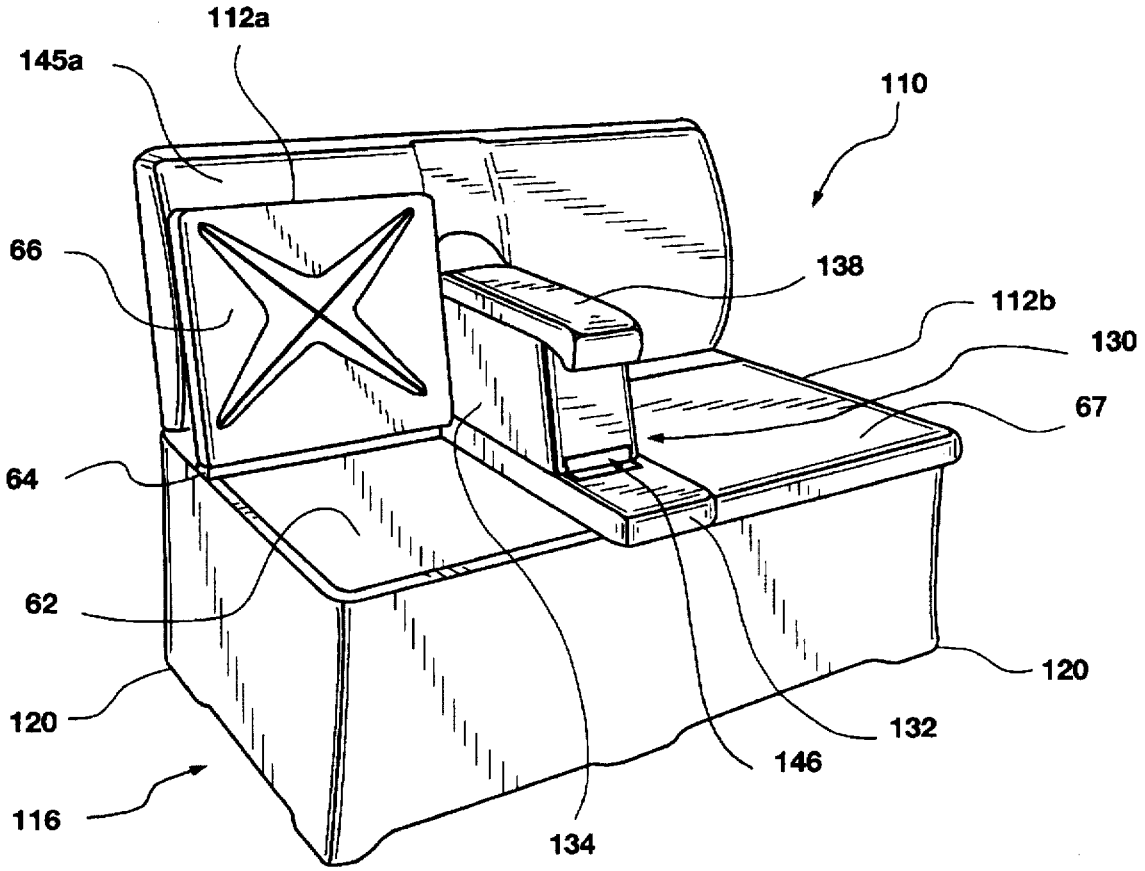
FIG. 5 is a perspective view illustrating an alternate preferred embodiment of the convertible bench/table apparatus of the present invention, the convertible bench/table container apparatus being shown in a bench formation comprising a support frame having an internal chamber disposed therein.
Figure 6:
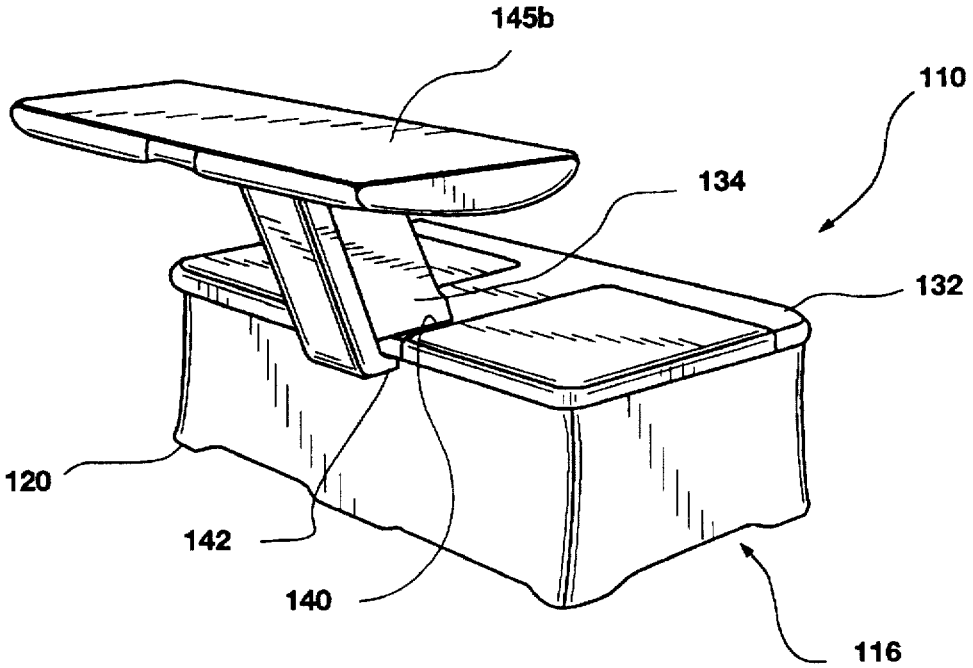
FIG. 6 is a perspective view illustrating one presently preferred embodiment of the convertible bench/table container apparatus as shown in FIG. 5 in a tabletop position.

Referring to FIGS. 5 and 6 which illustrate an alternative preferred embodiment of the present invention, a convertible bench/table container apparatus, described generally at 110, is shown as comprising a support container assembly 116 having an internal storage chamber 62 disposed therein. In construction, one presently preferred embodiment of the convertible bench/table container apparatus 110 of the present invention is formed of a sufficiently sturdy, composite material having significant rigidity and endurance to accommodate the purposes of the present invention. Correspondingly, the convertible bench/table container 110 may be formed of a wide variety of other suitable materials, such as, for example, wood, metal, ceramic, fiberglass, graphite, any of numerous organic, synthetic or processed materials that are mostly thermoplastic or thermosetting polymers of high molecular weight and that can be molded, case, extruded, drawn or laminated into objects, or any other suitable composite or polymeric material.

In current design, the support container assembly 116 is formed having multiple support legs 120. Support legs 120 provide means for elevating the support container assembly 116 from the surface of the floor or ground in order to protect the bottom of the support container assembly 116 from dirt, water, debris or other damaging substances.

Figure 7:
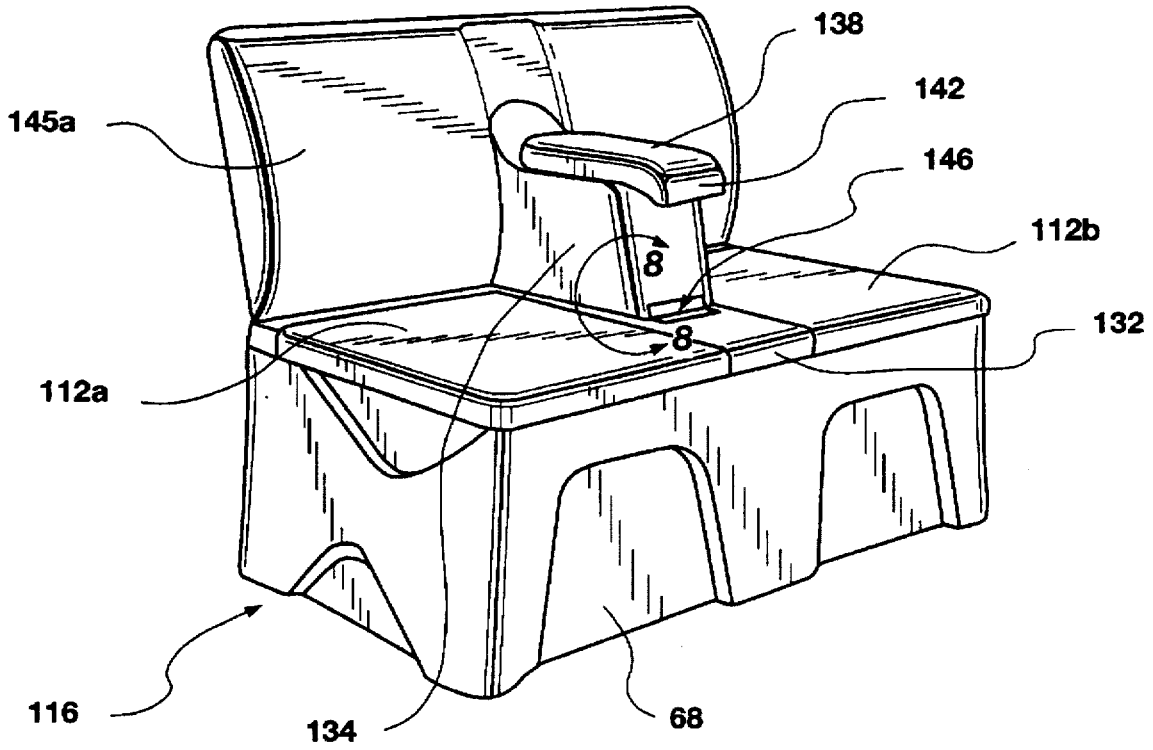
FIG. 7 is a perspective view illustrating a second alternate preferred embodiment of the convertible bench/table apparatus of the present invention, the convertible bench/table container apparatus being shown in a bench formation comprising a support frame having an internal chamber disposed therein and multiple recessed areas providing structural support to the frame.

As depicted in FIG. 7, an alternate preferred embodiment of the support container assembly 116 of the convertible bench/table container apparatus 110 is formed having multiple recessed areas 68 disposed in the exterior surface of the body of the support container assembly 116. The multiple recessed areas 68 provide additional structural integrity and reinforcement to the support container assembly 116, thus providing means for counteracting the depression forces exercised thereon.

Referring back to FIG. 5, the support container assembly 116 is preferably formed having a base board member 132 and one or more openable seat members 112*a*, 112*b*. The base board member 132 may be securely attached to an upper portion of the support container assembly 116. Preferably, the base board member 132 is formed having a substantially T-shaped configuration which is preferably disposed in relation to the upper portion of the support container assembly 116 by means of fasteners, such as, for example, screws, bolts, rivets, nails, etc. or by means of a conventional adhesive.

Similarly, the external edges of the seat members 112*a*, 112*b* are preferably disposed over a raised rim section of the upper surface portion of the support container assembly 116 and hingeably connected at opposing sides of the midsection of the base board member 132. Alternatively, the seat members 112*a*, 112*b* may be removably disposed in connection with the raised rim section of the upper surface of the support container assembly 116 without a hingeable connection provided therebetween.

In preferred construction, the exterior surface 67 of the seat members 112*a*, 112*b* is formed having a substantially flat, smooth surface, which, as used herein, means that the surface is substantially free from roughness and/or external projections. Further, the surface of seat members 112*a*, 112*b* may be formed having a concave or contoured shape to provide means for seating comfort. It will be appreciated by those skilled in the art, however, that other possible shapes or configurations of the seat members 112*a*, 112*b* and support container assembly 116 may be provided which are consistent with the spirit and scope of the present invention.

When the hingeable seat members 112*a*, 112*b* are in a closed position, the external edges of the interior surface 66 of the seat members 112*a*, 112*b* may be disposed in alignment with the raised rim provided by the upper portion of the support container assembly 116, whereby providing a structural support ridge for the seat members 112*a*, 112*b*. In addition, since depression forces may be directly applied against the seat members 112*a*, 112*b*, an internal reinforcing structure may be formed on the interior surface 66 of the seat members 112*a*, 112*b* to provide additional structural integrity, as best shown in FIG. 5.

In one presently preferred embodiment, the seat members 112*a*, 112*b* are hingeably attached along one side to the base board member 132. Preferably, the seat members 112*a*, 112*b* are connected to the base board member 132 by an elongated hinge-like structure 64 preferably disposed between the contacting edge of the base board member 132 and the seat members 112*a*, 112*b*.

The elongated hinge-like structures 64 connecting the seat members 112*a*, 112*b* to the base board member 132 are preferably formed of a substantially flexible material such as, for example, an organic, synthetic or processed thermoplastic or thermosetting polymer of high molecular weight which can be molded, cast, extruded, drawn or laminated onto objects, and which is sufficiently sturdy and capable of withstanding shock without permanent deformation. It will be readily appreciated by those skilled in the art, however, that the hinge-like structure 64 can, of course, be formed of a wide variety of other suitable materials which are consistent with the spirit and scope of the present invention.

Alternatively, situated at any preferred location, one or more hinge-like structures 64 or conventional hinge brackets may provide a hingeable connection between the contacting edges of the base board member 132 and the seat members 112*a*, 112*b* to provide means for pivoting the seat members 112*a*, 112*b* from an open position to a closed position, or vice versa, over the internal storage chamber 62 of the support container assembly 116. Moreover, a seat member support connection (not shown) preferably secured within the internal storage chamber 62 of the support container assembly 116 at a first end and operably engaging the interior surface 66 of the seat members 112*a*, 112*b* at a second end may be provided to maintain the seat members 112*a*, 112*b* in an open position for ready access into the storage chamber 62. For example, the seat member support connection may comprise a spring-loaded or a hydraulic mechanism. Consistent with the foregoing, it is intended that the examples provided herein be viewed as exemplary of the principles of the present invention, and not as restrictive to a particular structure or device for implementing those principles.

As noted above, the seat members 112*a*, 112*b* operate as means for facilitating access to the internal storage chamber 62 disposed within the support container assembly 116. In particular, the internal chamber 62 can be used to provide storage means for children's toys, clothing, blankets, etc. or for use as an ice chest, food receptacle, etc. Alternatively, the internal storage chamber 62 can be partitioned into one or more separate storage chambers, as desired.

Figure 8:
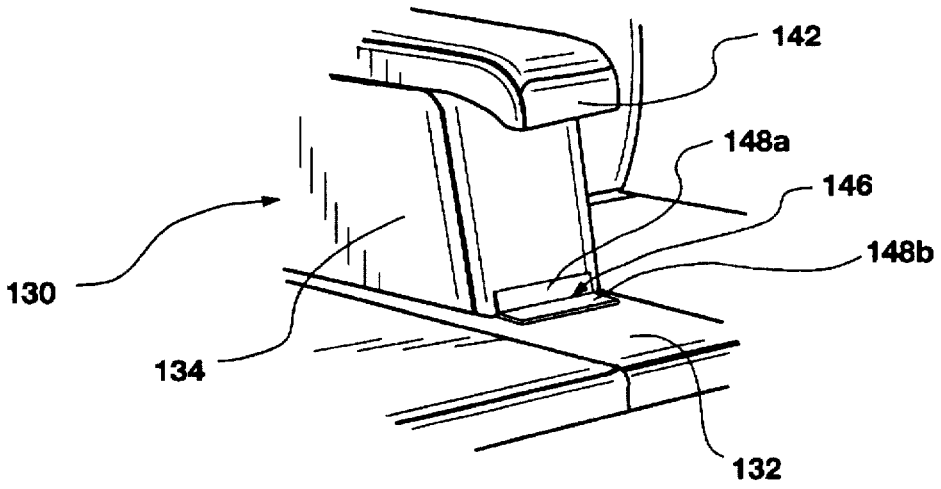
FIG. 8 is an enlarged perspective view taken along lines 8—8 of FIG. 7 showing the hinge mechanism of the armrest assembly which provides a form of pivotal support when manipulating the convertible bench/table container apparatus from the first position to the second position.

Referring now to FIGS. 5, 7 and 8, engaging the base board member 132 in a second position is an armrest assembly 130. In one presently preferred alternate embodiment of the present invention, the armrest assembly 130 comprises a second member 134 and a lateral extension 138 attached thereto and extending transversely a length greater than the length of the second member 132. In design, the second member 134 is formed being substantially rectangular in shape and comprising a majority of the body of the armrest assembly 130. Similarly, the height of the second member 134 directly relates to the height consistency of the tabletop (or desktop) **145*b* when the convertible bench/table container 110 is disposed in a first position, as represented in FIG. 6. Moreover, the second member 134 may be formed having an angle of disposition at between approximately 25° and 35°. In this regard, the angular disposition of the second member 134 in respect to the base board member 132 may provide a substantial relationship to the distance of the tabletop (or desktop) 145*b* from the edge of the support container assembly 116**.

Attached to the backside of the second member 134 of the armrest assembly 130 is a backrest **145*a* preferably secured by means of fasteners such as, for example, screws, bolts, rivets, nails, etc. or by a conventional adhesive. Preferably, the configuration of the backrest 145*a* is ergonomically designed to provide a suitable structure for comfort and durability. Whereas, when the convertible bench/table container 110 is disposed in the second position as represented by FIGS. 5 and 7, the armrest assembly 130 extends substantially horizontal to provide a backrest 145*a* for the seat members 112*a*, 112*b* and a bench for sitting and relaxing. Correspondingly, when the conver container 110 is in container 110 is in the first position as represented by FIG. 6, the body of the armrest assembly 130 preferably rests on one side in a substantially upright position, thereby exhibiting a tabletop (or desktop) 145*b***.

As illustrated in FIG. 8, the second member 134 of the armrest assembly 130 is preferably attached to the base board member 132 by means of an elongated hinge-like structure 146 disposed between the facing of the second member 134 and the upper surface of the base board member 132. The elongated hinge-like structure 146 integrally connecting the second member 134 of the armrest assembly 130 to the base board member 132 is preferably formed of a substantially flexible material such as, for example, an organic, synthetic or processed thermoplastic or thermosetting polymer of high molecular weight which can be molded, cast, extruded, drawn or laminated onto objects, and which is sufficiently sturdy and capable of withstanding shock without permanent deformation. It will be readily appreciated, however, that the hinge-like structure 146 can, of course, be formed of a wide variety of other suitable materials which are consistent with the spirit and scope of the present invention.

In preferred design, the hinge-like structure 146 provides means for allowing the armrest assembly 130 to be pivoted from a horizontal position into a vertical position, whereby the backrest/tabletop 145 may be transformed from a bench with a backrest **145*a* into a tabletop (or desktop) 145*b*. Alternatively, situated at any preferred location, one or more hinge-like structures 146 or one or more conventional hinge brackets may be operably disposed between the second member 134 and the base board member 132 to provide an alternate means for pivoting the backrest/tabletop 145** from the first position to the second position, or vice versa.

Similarly, the hinge bracket 146 is preferably formed having an L-shaped configuration comprising a first hinge bracket arm **148*a* attached to the front facing of the second member 134 and a second hinge bracket arm 148*b* attached to the base member 132 which, in operation, facilitates the pivotal connection therebetween, as best shown in FIG. 8. In an alternate preferred embodiment, the second hinge bracket arm 148*b* may be situated beneath the second member 134 for purposes of hiding the second bracket arm 148*b* from view. Moreover, the hinge bracket arm 148*a* may be situated beneath the second member 134. In this regard, to compensate for the relative thickness of the hinge bracket 146, a recessed area may be formed on the second member 134 and/or within the base member 132**, as needed.

Referring back to FIG. 6, the second member 134 of the armrest assembly 130 facilitates a surface abutment against the base board member 132 by acting as a first structural stop 140 when the convertible bench/table container 110 is in a tabletop (or desktop) formation **145*b*. In function, the first structural stop 140 provides structural integrity to the tabletop (or desktop) 145*b*** and the forces applied thereto.

In addition to the first structural stop 140, the lateral extension 138 of the armrest assembly 130 preferably provides a surface abutment against the support container assembly 116 to facilitate a second structural stop 142 for supporting the tabletop (or desktop) **145*b*. Accordingly, the portion of the lateral extension 138 of the armrest assembly 130 which extends beyond the body of the second member 134 may become substantially displaced vertically when the convertible bench/table container 110 is pivoted at the hinge bracket 146**.

Upon the substantial vertical displacement of the backrest/tabletop 145, the lateral extension 138 preferably abuts the front side of the support container assembly 116, thereby exerting a functional restriction on any further forward pivoting movement on the part of the backrest/tabletop 145 and thus conforming to a second structural support stop 142. It will be readily appreciated by those skilled in the art, however, that one or more structural stops may be provided to facilitate means for supporting the tabletop **145*b* when the convertible bench/table container 110** is disposed in the first position. Accordingly, those skilled in the art will readily recognize other possible modifications and adaptations to the armrest assembly of the convertible bench/table container which are consistent with the spirit and scope of the present invention.

Figure 9:
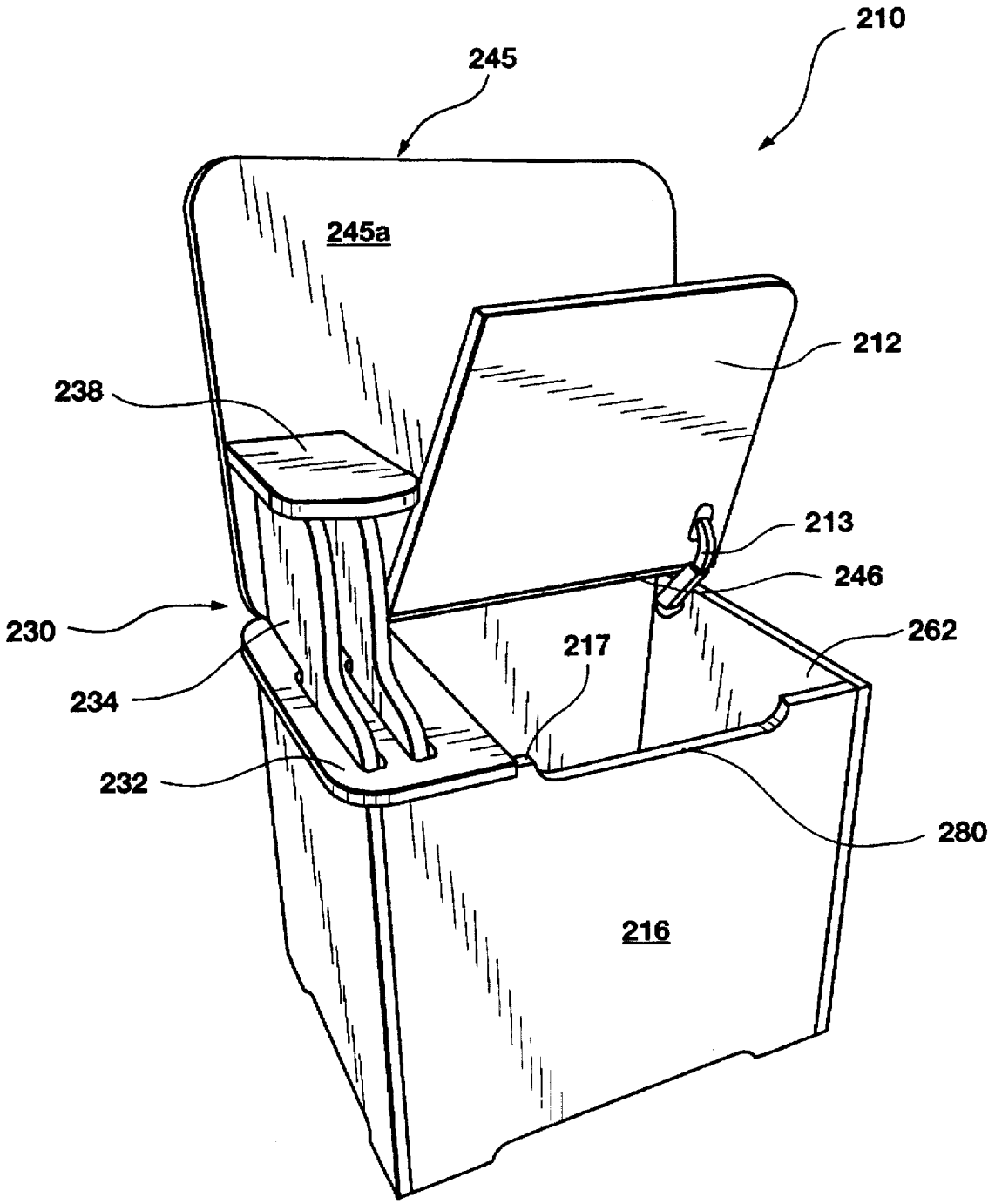
FIG. 9 is a perspective view illustrating an alternate preferred embodiment of the convertible bench/table container apparatus, the apparatus being shown in a bench with backrest formation.
Figure 10:
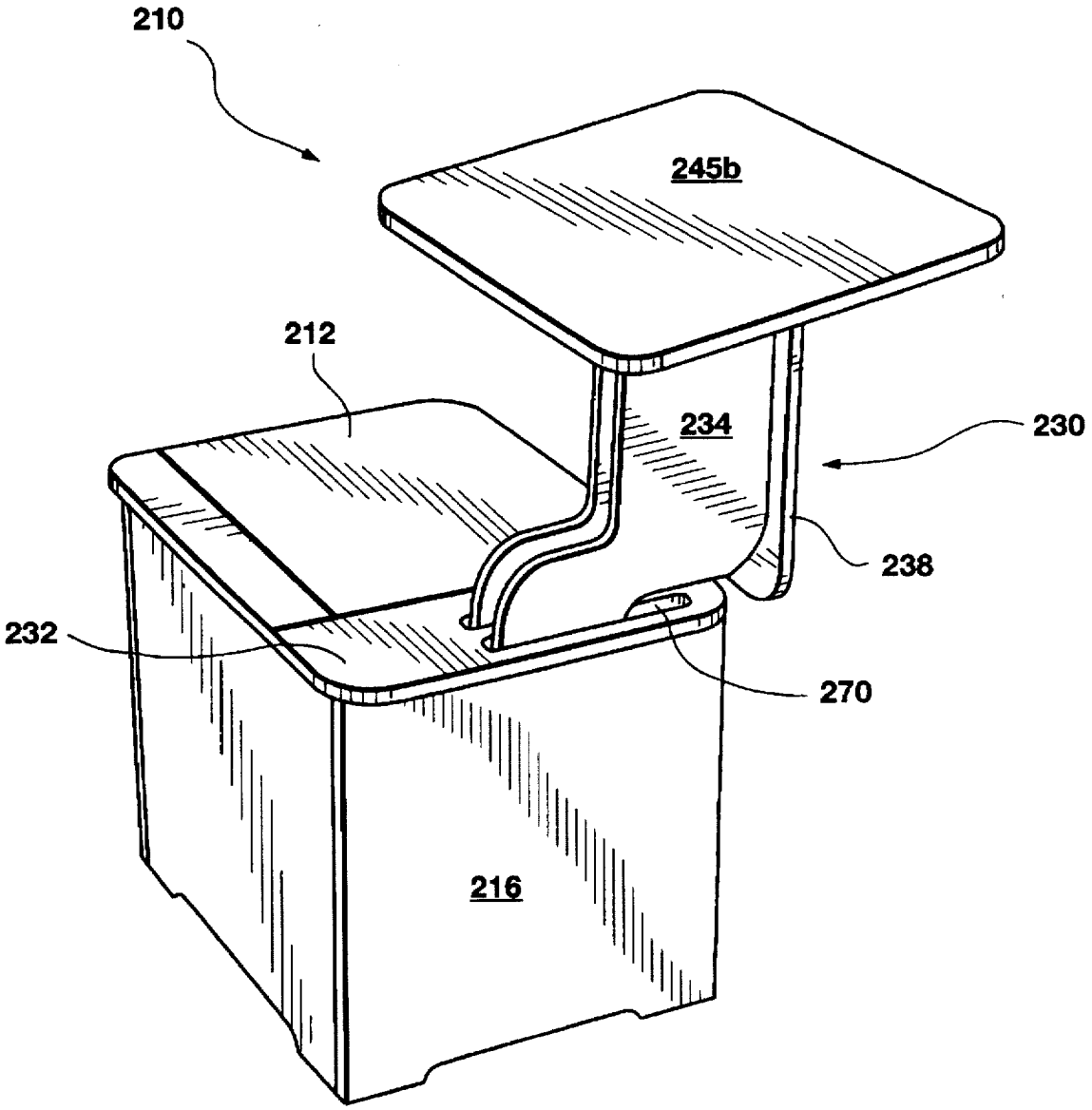
FIG. 10 is a perspective view showing one presently preferred alternate embodiment of the convertible bench/table container apparatus as shown in FIG. 9, the apparatus being shown in a tabletop position.
Figure 11:
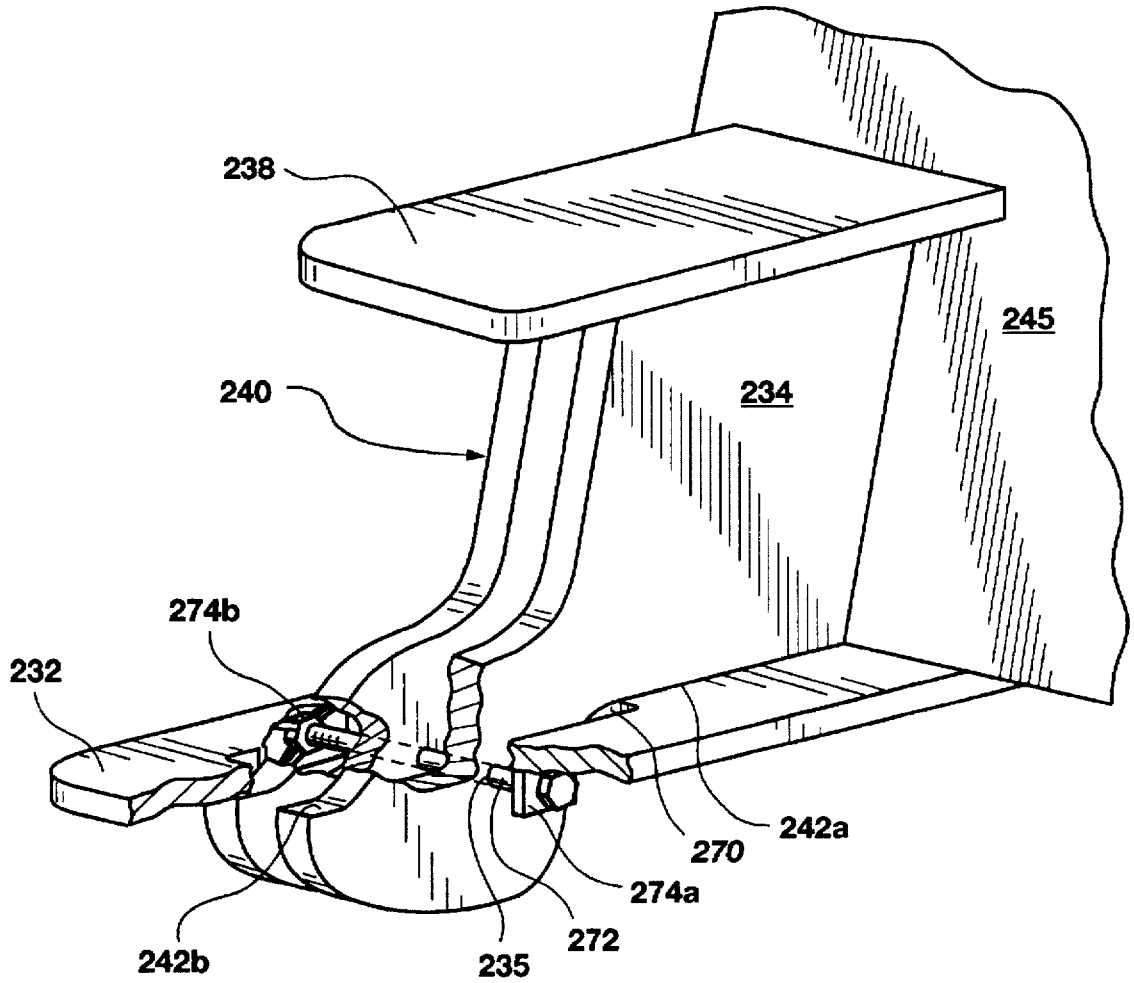
FIG. 11 is an enlarged perspective view an alternate preferred embodiment of a pivotal armrest assembly of one presently preferred embodiment of the convertible bench/table container apparatus, the armrest assembly providing means for pivotally supporting the tabletop or backrest when manipulating the convertible bench/table container apparatus from the first position to the second position, or vice versa.

For example, an alternate embodiment of the armrest assembly of one presently preferred embodiment of the convertible bench/table container apparatus is illustrated in FIGS. 9, 10 and 11. As best shown in FIG. 9, the convertible bench/table container, designated generally at 210, comprises a support container assembly 216 having an internal storage chamber 262 and a base board member 232. The base board member 232 is preferably formed having an L-shape configuration.

In present construction, at least one seat member 212 preferably engages the base board member 232 by means of a hinge bracket 246 and provides means for pivotally covering the opening of the internal storage chamber 262. Moreover, the seat member 212 may be disposed in operable relation to a raised rim section 217 formed at the upper surface portion of the internal storage chamber 262 of the support container assembly 216. In this manner, when the seat member 212 is adjusted in a closed position, the external edges of the interior surface of the seat member 212 preferably engage the raised rim 217 of the support container assembly 216 thereby providing additional structural support against the forces applied against the seat member 212. Alternatively, the seat member 212 may be removably disposed in connection with the raised rim section 217 of the upper surface of the support container assembly 216 without facilitating a hingeable connection provided therebetween.

As illustrated in FIG. 9, an elongated recess 280 is preferably formed in the front facing of the upper surface portion of the support container assembly 216 to provide means for easily accessing and lifting the seat member 212 into an open position, thus displaying the contents of the internal storage chamber 262 of the support container assembly 216. In addition, a seat support connection 213 may be incorporated into the structural design of one preferred embodiment of the convertible bench/table container 210 of the present invention. Preferably, the seat support connection 213 is formed having a first end engaging an area of the internal storage chamber 262, a second end engaging an area of the internal surface of the openable seat member 212, and an intermediate curvilinear portion extending between both the first and second ends thereof.

In operation, the seat support connection 213 provides means for maintaining the seat member 212 in a variable open position, thus providing means for restricting downward movement of the openable seat member 212 without any application of depression forces, other than gravity, acting thereagainst. For example, the seat support connection 213 may include a conventional spring-loaded assembly, a hydraulic mechanism, or some other suitable component or device. It will be readily appreciated that the foregoing structural features (i.e., the elongated recess 280 and/or the support connection 213) may be incorporated into the design of the convertible bench/table container apparatus 210 for the purpose of facilitating additional advantages in utilization. Incorporating these additional structural features into the overall design of the preferred embodiments of the convertible bench/table container apparatus 110, 210, however, is not intended to restrict or further limit the scope of the present invention.

The alternate preferred embodiment of the convertible bench/table container 210 of the present invention, as shown in FIGS. 9 and 10, comprises at least one pivotal armrest assembly 230 and at least one openable seat member 212. Consistent with the size and functionality of the preferred embodiment(s) of the convertible bench/table container 210, it will be readily appreciated by those skilled in the art that one or more pivotal armrest assemblies 230 and/or seat members 212 are possible. In addition, the convertible bench/table container 210 may comprise multiple recessed areas disposed in the exterior surface or facing of the support container assembly 216 to facilitate added structural integrity and/or support, as shown, by example, in FIG. 7. Consistent with the foregoing, it is intended that the examples of various embodiments of the present invention provided herein be viewed as exemplary of the principles of the present invention, and not as restrictive to a particular structure or device for implementing those principles.

When the presently preferred alternate embodiment of the convertible bench/table container 210 is pivotally disposed into a second position as shown in FIG. 9, the convertible bench/table container conforms to a suitable bench including a backrest 245*a*, an openable seat member 212, and an armrest assembly 230. Correspondingly, when the convertible bench/table container 210 is pivotally disposed into a first position as illustrated in FIG. 10, the convertible bench/table container 210 converts to a suitable table formation providing a tabletop (or desktop) 245*b*, a seat member 212, and an armrest assembly 230 which provides a first structural stop 240 against a portion of the base board member 232 of the support container assembly 216 to provide means for supporting the tabletop (or desktop) 245*b* in relation to the support container assembly 216.

Referring now to FIG. 11, the armrest assembly 230 comprises at least one second member 234 and a lateral extension 238. Preferably, the lateral extension 238 is transversely disposed in connection at a proximate end of the second member 234 and may be formed having a length extending greater than the length of the proximate end of the second member 234.

In one presently preferred embodiment of the armrest assembly 230, the second member 234 consists of at least two members disposed substantially perpendicular to the support container assembly 216 and disposed in general alignment with each other. The second members 234 are preferably formed including a complimentary first section having a substantially rectangular configuration and a second section having a general curvilinear configuration which defines a shape providing means for pivotally interacting with a conventional pivot member 272 disposed in operable relation thereto. The second members 234 preferably comprise a majority of the body of the armrest assembly 230. Similarly, the height of the second member 234 directly relates to the height consistency of the tabletop (or desktop) 245*b* when the convertible bench/table container 210 is disposed in a first position, as represented in FIG. 10. Moreover, the front facing of the second member 234 may be formed having an angle of disposition at between approximately 25° and 35°. In this regard, the angular disposition of the second member 234 in respect to the base board member 232 may provide a substantial relationship to the distance of the tabletop (or desktop) 245*b* from the edge of the support container assembly 216.

Attached to back of the second member 234 of the armrest assembly 230 is a backrest/tabletop 245 preferably secured by means of fasteners such as, for example, screws, bolts, rivets, nails, etc. or by a conventional adhesive. The configuration of the backrest/tabletop 245 may be designed to provide a suitable backrest 245*a* for comfort and durability and a tabletop (or desktop) 245*b* providing adequate dining or work space. Whereas, when the convertible bench/table container 210 is disposed in the second position as represented by FIG. 9, the armrest assembly 230 extends substantially horizontal to provide a backrest 245*a* for the seat member 212. Correspondingly, when the convertible bench/table container 210 is in the first position as represented by FIG. 10, the body of the upper section of the second member 234 of the armrest assembly 230 preferably rests on one side in a substantially upright position to provide a first structure stop 240, thereby exhibiting a tabletop (or desktop) 245*b*.

In addition to the first structural stop 240, an alternate embodiment of the armrest assembly 230 provides the portion of the lateral extension 238 which extends beyond the length of the second member 234 as a surface abutment potentially acting against the body of the support container assembly 216 to provide an additional structural stop for supporting the tabletop (or desktop) 245*b* upon conversion. Upon substantial vertical displacement of the backrest/tabletop 245, the lateral extension 238 may abut the front side of the support container assembly 216, thereby exerting a functional restriction on any further forward pivoting movement on the part of the backrest/tabletop 245. Based on the foregoing, it will be readily appreciated by those skilled in the art, however, that at least one structural stop may be provided to facilitate means for supporting the tabletop (or desktop) 245*b* when the convertible bench/table container 210 is disposed in the first position, as shown in FIG. 10. Accordingly, those skilled in the art will readily recognize other possible modifications and adaptations which are consistent with the spirit and scope of the present invention.

As illustrated, the lower section of the second member 234 is introduced substantially through an elongated slot 270 formed in the base board member 232. Preferably, the elongated slot 270 is formed having a cross-sectional width and dimension sufficient for introducing and pivoting the lower section of the second member 234 therein. It will be readily appreciated that the number of elongated slots 270 formed in the base board member 232 of the support container assembly 216 may correspond to the number of second members 234 comprising the armrest assembly 230.

In operation, a through-bore 235 may be formed in the lower section of the second member 234 wherethrough the pivot member 272 may be introduced, thus providing means for retaining the second member 234 of the armrest assembly 230 in pivotal relation to the support container assembly 216. As illustrated herein, the pivot member 272 may be formed having an elongated, cylindrical configuration. It will be readily appreciated, however, that other shapes or configurations are possible.

Preferably, the pivot member 272 is mounted in relation to the support container assembly 216 by means of conventional fixation members **274*a*, 274*b* secured thereto. For example, in one presently preferred embodiment, the fixation member 274*a* consist of a mounted retainer ear fastened to the internal side of the base board member 232 and the fixation member 274*b* may include a conventional keeper comprising a lock nut for rotatably introducing the threaded end of a pivot member, as illustrated in FIG. 11. Functionally, the fixation members 274*a*, 274*b* comprise means for engaging, mounting and/or suspending the pivot member 272 in relation to the support container assembly 216. As noted above, the pivot member 272 is preferably introduced through the through-bore 235 formed in the second member 234 of the armrest assembly 230, thus facilitating a point of pivotal rotation between the armrest assembly 230 and the support container assembly 216. Accordingly, the structural design of the pivotal support assembly provides means for manipulating the convertible bench/table container 210 from a bench structure having a seat and backrest 245*a* into a tabletop (or desktop) 245*b***.

It will be apparent that other fixation or pivotal mechanisms may be constructed which are in accordance with the inventive principles set forth herein. For example, numerous fixation and/or pivotal support assemblies may be developed to provide the support required for pivoting the armrest assembly 230 in relation to the support container assembly 216. It is intended, therefore, that the examples provided herein be viewed as exemplary of the principles of the present invention, and not as restrictive to a particular structure for implementing those principles.

Referring to FIGS. 9 and 11, the second member 234 of the armrest assembly 230 facilitates at least one structural surface abutment against the base board member 232 by acting as a second structural stop 242 when the convertible bench/table container 210 is manipulated into the bench formation for displaying a backrest **245*b*. In function, a second structural stop 242 provides a surface abutment corresponding to a side 242*a* of the second member 234 acting against the exterior surface of the base board member 232. Similarly, an additional structural stop may provide a surface abutment by means of a ridge 242*b* formed in the lower portion of the second member 234 which acts against the internal surface of the base board member 232. In particular, the second structural stop 242*a*, 242*b* provides means for limiting further pivotal movement and, accordingly, provides structural integrity to the backrest 245*a* and the forces applied thereagainst when the convertible bench/table container 210** is manipulated into the second position.

Consistent with the foregoing, the new pivotal support assembly for the armrest assembly 230 as disclosed above may be incorporated into the structural design of the convertible bench/ table apparatus 10 by means of replacing the hinge bracket 46 to provide an alternate embodiment of the convertible bench/table.

In current design, the embodiments of the convertible bench/table apparatus are preferably comprised of 100% natural redwood, however, other suitable materials may be used in the construction of the convertible bench/table apparatus or the bench/table container apparatus. For example, other types of wood or wood products, metal, fiberglass, any of numerous organic, synthetic or processed materials that are mostly thermoplastic or thermosetting polymers of high molecular weight and which can be molded, cast, extruded, drawn or laminated, or any other suitable material sufficient to accommodate the novel functional and structural elements and features of the present invention are possible.

Overall, the structure and design of the embodiments of the convertible bench/table and convertible bench/table container of the present invention are formed to be aesthetically pleasing to the eye and to furnish a pleasant sitting, studying and/or dining experience for those individuals leisurely relaxing in the yard, on the porch, or near the pool. In addition, the presently preferred embodiments of the convertible bench/table and bench/table container may also be used indoors for sitting, dining, or as a workstation surface when converted into the tabletop (or desktop) formation.

In use, for example, if a user wants to dine at a nearby campground, out on the lawn, or near the pool, the convertible bench/table or convertible bench/table container apparatus may be conveniently placed into the back of a truck or car for easy transportation to the campground, or may be quickly and easily converted into a suitable picnic table or desktop surface where it sits. Consistent therewith, one or more handles may be attached to the body of the convertible bench/table or bench/table container apparatus for easy manipulation and portability. In operation, by lifting and pivoting the backrest and armrest assembly on its side as accomplished by means of a hinge member or pivotal support assembly and at least one structural stop, the backrest can be transformed into a tabletop (or desktop) to provide a surface area for a family picnic or for accommodating other activities.

Figure 3:
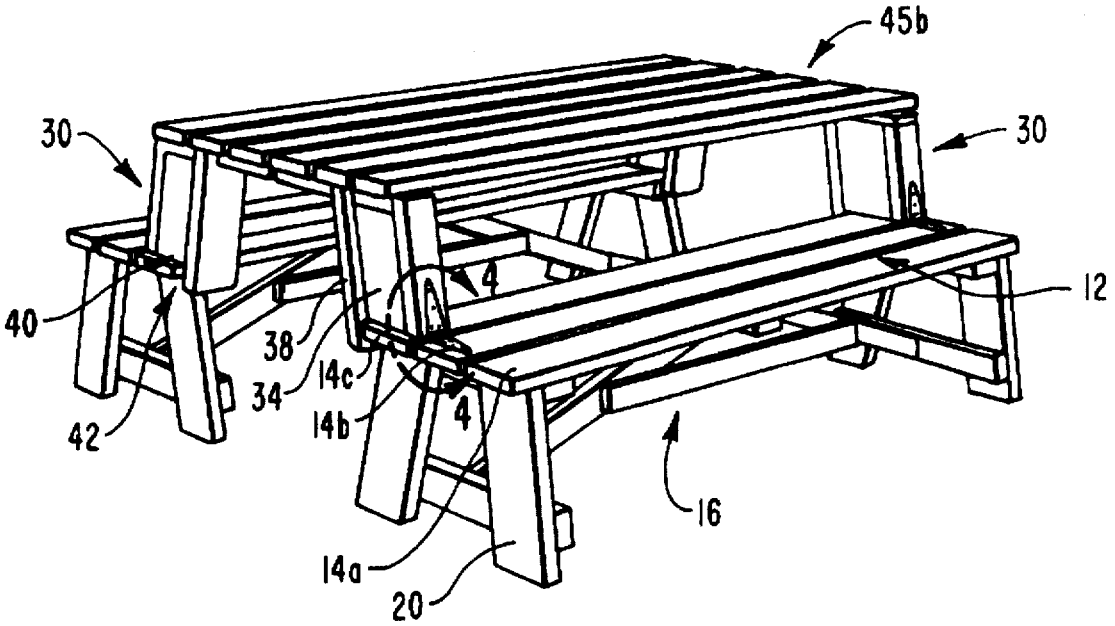
FIG. 3 is a perspective view of a convertible bench/table apparatus in accordance with the present invention being aligned with an opposing convertible bench/table apparatus to provide a larger tabletop surface, analogous to a conventional picnic table.

If a larger tabletop is required to feed family and friends, a pair of convertible bench/tables of the present invention can be transformed into their tabletop formations and placed on opposite sides, thus aligning the two tabletops together to form a larger tabletop providing seats on the opposite sides thereof, as represented in FIG. 3. In the same manner, a pair of convertible bench/table containers of the present invention may be positioned opposite one another, thus aligning the two tabletops to provide a larger surface area or work space.

From the above discussion, it will be appreciated that the present invention provides a new and improved functional and structural design for convertible bench/table and convertible bench/table container structures. The present invention further provides an aesthetically pleasing piece of recreational furniture which may be formed of a natural redwood construction and finished with an outdoor ultraviolet weather resistant stain to preserve the wood's natural beauty, or formed of a particle board or other type of wood or wood product. In the alternative, the present invention may be formed of a polymeric, composite material for its lightweight, strength and durability. Similarly, the present invention has a reduced number of mechanical working parts, as compared to prior art devices, thereby effecting a decrease in the overall manufacturing and production costs.

Unlike prior art devices, the apparatus of the present invention is easy to assemble and provides a simple, easy means for converting a bench structure with a backrest into a picnic table (or desktop) formation. In particular, the present invention provides a convertible bench/table container apparatus having an internal storage chamber disposed therein for storing children's toys, clothing, blankets, etc. or for use as an ice chest, food receptacle, etc. Consistent with the foregoing, both the preferred and alternate embodiments of the present invention readily provide for both convenience and usage indoors and outdoors. Moreover, during the inventors experimentation, the present invention has been shown to have significant and effective advancements both functionally and structurally over known prior art devices.

As noted above, the present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A convertible bench/table apparatus, comprising:

at least one seat member;

means for supporting said seat member;

a backrest/tabletop member;

at least one support assembly for structurally supporting said backrest/tabletop member in relation to said means for supporting said seat member, said support assembly comprising a pivot assembly providing means for pivoting the backrest/tabletop member from a first position, exhibiting said seat member with an adjacent tabletop, into a second position, exhibiting said seat member with a backrest, and vice versa;

said support assembly comprising at least one support member disposed substantially perpendicular to said means for supporting said seat member, said support member including a first section having a substantially rectangular configuration, a second section having a general curvilinear configuration, and a through-bore formed in said second section, said through-bore providing means for operably engaging said pivot assembly; and said support assembly further comprising at least one structural stop engaging said means for supporting said seat member, said structural stop providing means for sustaining said tabletop when pivoting said backrest/tabletop member into said first position.

2. A convertible bench/table apparatus as defined in claim 1 further comprising said support assembly including a second structural stop engaging said means for supporting said seat member, said second structural stop providing means for sustaining said backrest when pivoting said backrest/tabletop member into said second position.

3. A convertible bench/table apparatus as defined in claim 1 wherein said seat member comprises an elongated slot formed therein for introducing a portion of said support assembly therethrough.

4. A convertible bench/table apparatus as defined in claim 1 wherein said pivot assembly comprises an elongated pivot member disposed in pivotal relation to said support assembly.

5. A convertible bench/table apparatus as defined in claim 4 wherein said pivot member is fixed in relation to said means for supporting said seat member.

6. A convertible bench/table apparatus as defined in claim 1 wherein said seat member being hingeably attached to said means for supporting said seat member.

7. A convertible bench/table apparatus as defined in claim 1 wherein said means for supporting said seat member comprises a rim section providing means for supporting said seat member when disposed in relation thereto.

8. A convertible bench/table apparatus as defined in claim 1 wherein said means for supporting said seat member comprises a base board member.

9. A convertible bench/table apparatus as defined in claim 8 wherein said base board member comprises at least one elongated slot formed therein for introducing a portion of said support assembly therethrough.

10. A convertible bench/table container apparatus, comprising:

at least one seat member;

means for supporting said seat member, said support means having an internal chamber;

a backrest/tabletop member;

at least one support assembly for structurally supporting said backrest/tabletop member in relation to said means for supporting said seat member, said support assembly comprising a pivot assembly providing means for pivoting the backrest/tabletop member from a first position, exhibiting said seat member with an adjacent tabletop, into a second position, exhibiting said seat member with a backrest, and vice versa;

said support assembly comprising at least one support member disposed substantially perpendicular to said means for supporting said seat member, said support member including a first section having a substantially rectangular configuration, a second section having a general curvilinear configuration, and a through-bore formed in said second section, said through-bore providing means for operably engaging said pivot assembly; and said support assembly further comprising at least one structural stop engaging said means for supporting said seat member, said structural stop providing means for sustaining said tabletop when pivoting said backrest/tabletop member into said first position.

11. A convertible bench/table container apparatus as defined in claim 10 further comprising said support assembly including a second structural stop engaging said means for supporting said seat member, said second structural stop providing means for sustaining said backrest when pivoting said backrest/tabletop member into said second position.

12. A convertible bench/table container apparatus as defined in claim 10 wherein said seat member is removably disposed in relation to said means for supporting said seat member.

13. A convertible bench/table container apparatus as defined in claim 10 wherein said seat member is hingeably attached to said means for supporting said seat member.

14. A convertible bench/table container apparatus as defined in claim 10 wherein said internal chamber comprises multiple side panels and a bottom panel.

15. A convertible bench/table container apparatus as defined in claim 10 wherein said means for supporting said seat member comprises a rim section providing means for supporting said seat member when disposed in relation thereto.

16. A convertible bench/table container apparatus as defined in claim 10 wherein said means for supporting said seat member comprises a base board member disposed over a section of said internal chamber.

17. A convertible bench/table container apparatus as defined in claim 16 wherein said base board member comprises at least one elongated slot formed therein for introducing a portion of said support assembly therethrough.

18. A convertible bench/table container apparatus as defined in claim 10 wherein said pivot assembly comprises an elongated pivot member disposed in pivotal relation to said support assembly.

19. A convertible bench/table container apparatus as defined in claim 18 wherein said pivot member is fixed in relation to said means for supporting said seat member.

* * * * *